US005865912A

United States Patent [19]

Morimoto et al.

[11] Patent Number: 5,865,912

[45] Date of Patent: Feb. 2, 1999

[54] SIC-REINFORCED ALUMINUM ALLOY COMPOSITE MATERIAL

[75] Inventors: Hiroyuki Morimoto, Himeji; Kenichiro Ouchi; Hiroshi Iwamura, both of Kobe, all of Japan

[73] Assignee: Kabushiki Kaisha Kobe Seiko Sho, Kobe, Japan

[21] Appl. No.: 106,796

[22] Filed: Aug. 16, 1993

Related U.S. Application Data

[63] Continuation of Ser. No. 874,202, Apr. 27, 1992, abandoned, which is a continuation of Ser. No. 446,373, Dec. 5, 1989, abandoned.

[30] Foreign Application Priority Data

Feb. 13, 1989 [JP] Japan ..... 1-33924

[51] Int. Cl.[6] ..... C22C 21/00

[52] U.S. Cl. ..... 148/440; 420/542; 420/546; 420/548; 75/229; 75/236; 75/237; 75/241; 164/97; 428/614

[58] Field of Search ..... 420/548, 542, 420/546; 148/440; 164/97; 75/229, 236, 237, 241; 428/614

[56] References Cited

U.S. PATENT DOCUMENTS

| | | | |
|---|---|---|---|
| 4,753,690 | 6/1988 | Wada et al. | 148/440 |
| 4,756,753 | 7/1988 | Miura | 419/17 |
| 4,828,008 | 5/1989 | White et al. | 164/97 |

FOREIGN PATENT DOCUMENTS

| | | | |
|---|---|---|---|
| 60-251922 | 6/1985 | Japan . | |
| 62-89801 | 4/1987 | Japan . | |
| WO 85/01246 | 3/1985 | WIPO | 264/108 |
| WO 89/00614 | 1/1989 | WIPO | 420/129 |

*Primary Examiner*—Sikyin Ip
*Attorney, Agent, or Firm*—Oblon, Spivak, McClelland, Maier & Neustadt, P.C.

[57] ABSTRACT

Described herein is an SiC-reinforced aluminum alloy composite material of the type having silicon carbide uniformly dispersed in an aluminum alloy matrix containing magnesium as a strengthening element, characterized in that the composite material contains Al4C3 in an amount smaller than 0.5 wt % and residual oxygen in an amount smaller than 0.4 wt %, and has a modulus of elasticity higher than 9000 kgf/mm$^2$.

2 Claims, 7 Drawing Sheets

SIC-REINFORCED ALUMINUM ALLOY COMPOSITE MATERIAL

This application is a Continuation of application Ser. No. 07/874,202, filed on Apr. 27, 1992, now abandoned, which is a continuation of Ser. No. 07/446,373, filed Dec. 5, 1989, now abandoned.

FIELD OF THE INVENTION

This invention relates to an SiC-reinforced aluminum alloy composite material of high strength.

BACKGROUND OF THE INVENTION

Because of excellent properties in specific strength, specific modulus of elasticity, fatigue strength and resistance to abrasive wear, the ceramic-reinforced Al alloy composite material, a product formed by integrally compounding a lightweight metal Al alloy with ceramics, has been drawing keen attention as a material for structural members of aerospace crafts, automobiles and office automation appliances or as a material for sports equipments.

The ceramic-reinforced Al alloy composite material is produced by a process of mixing Al alloy powder with reinforcing ceramic whisker or particles, preforming the powder mixture by hot pressing or hot isostatic pressing (HIP) and sintering the resulting shape or billet under pressure. In this instance, the properties of the product composite material are largely influenced by the dispersibility of the ceramic in the powder mixture, and therefore it is an important technical point to mix Al alloy powder uniformly with ceramic. The technology in this regard is important especially in a case where the ceramic is in the form of whiskers which easily get entangled. In an attempt to overcome this problem, Applicants proposed in their Japanese Laid-Open Patent Applications 62-89801 and 60-251922 a method of mixing the two materials uniformly by applying ultrasonic vibrations to whisker in an organic solvent, adding Al alloy powder with stirring, filtering by suction the resulting slurry of powder mixture, and removing the organic solvent by vacuum-drying the cake.

As the matrix, an Mg-containing Al alloy with age-strengthening property is generally used.

Although the above-described mixing means has made it possible to produce composite material of uniform properties, the art has not yet arrived at a stage where it can fully respond to the demands for further improvements in strength and modulus of elasticity.

OBJECT OF THE INVENTION

In view of these circumstances, it is a primary object of the present invention to provide a ceramic-reinforced Al alloy composite material with excellent properties particularly in strength and modulus of elasticity.

SUMMARY OF THE INVENTION

In accordance with the present invention, the above-mentioned object is achieved by the provision of an SiC-reinforced Al alloy composite material of the sort having SiC dispersed uniformly in an aluminum alloy matrix containing Mg as a strengthening element, characterized in that the composite material contains $Al_4C_3$ in an amount less than 0.5 wt % and residual oxygen in an amount less than 0.4 wt %. In this instance, remarkable effects for improving the strength and modulus of elasticity can be produced by using SiC in the form of whisker which is oriented in one direction by extrusion or other suitable method.

PARTICULAR DESCRIPTION OF THE INVENTION

In order to strengthen the interfacial bond of SiC and Al alloy in the press-sintering stage, it is necessary for SiC and Al alloy powder to be wet and react with each other to some extent. By this reaction, SiC is decomposed and $Al_4C_3$ is produced as a reaction product. However, if the reaction proceeds to such an excessive degree as to produce $Al_4C_3$ in an amount greater than 0.5% by weight (the percentages which will appear hereinlater are all percentages by weight unless otherwise specified), a marked drop in strength will result. Therefore, the $Al_4C_3$ content in the composite material of the invention is defined to be smaller than 0.5%.

Figure 1:
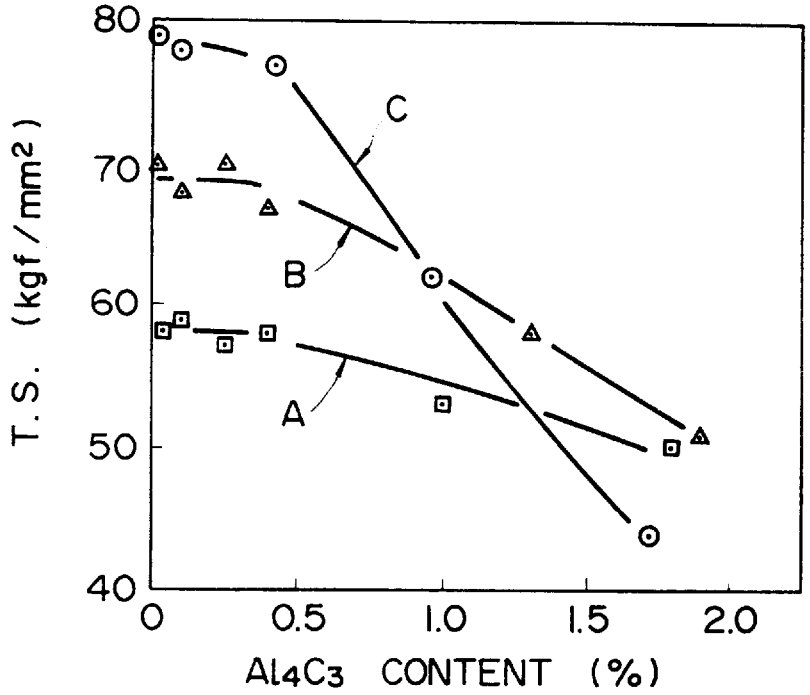
FIG. 1 is a graph showing the relationship between the $Al_4C_3$ content and tensile strength of various SiC-reinforced Al alloy composite materials.

As seen in the graph of FIG. 1 which shows the $Al_4C_3$ content in various SiC-reinforced Al alloy composite materials in relation with the tensile strength, the improvement in strength becomes conspicuous with a content less than 0.5%. The specimens were prepared by mixing Al alloy powder (A: 6061, B: 2024, C: 7075), with a classified particle size smaller than 0.5 mesh, with SiC whisker (blended in a proportion of 20 vol % in each of A, B and C), filling and sealing the powder mixture in HIP capsule after vacuum pumping, effecting a HIP treatment (2000 kgf/cm$^2$, 4 hrs.) at various temperatures, and extruding the billets, cut out of the resulting composite material, at a temperature of 460°–520° C. (C: 460° C., B: 480° C., C: 520° C.) and at an extrusion ratio of 30, followed by T6 treatment.

The content of residual oxygen in the composite material has close relation with the properties such as strength and hardness, which drop markedly when the residual oxygen content exceeds 0.4%. The reason for this is that, when the oxygen content is in excess of 0.4%, Mg which contributes to precipitation strengthening is susceptible to oxidation and converted into an oxide like MgO by oxygen which exists in the Al alloy matrix, resulting in a reduction in the amount or in extinction of fine Mg-containing aging precipitates in the matrix. Namely, for the purpose of attaining a marked improvement in strength, most of the Al alloys to be used as a matrix normally contain about 0.4–6.0% of Mg in the G.P. zone or by forming in the matrix uniformly dispersed fine aging precipitates smaller than 1 $\mu$m, such as $Mg_2Si$, $Al_2CuMg$, $Al_2Mg_3Zn_3$ and $MgZn_2$ or by solution strengthening. However, due to strong affinity with oxygen, Mg is very susceptible to oxidation and, once oxidized, the amount of Mg atoms which contribute to the precipitation effects is reduced, resulting in fading or vanishment of the strengthening effects. Although other aging precipitates (e.g., of $Al_2Cu$) which do not contain Mg contribute to the improvement of the strength, the decrease of the strengthening elements by oxidation is ignorable in the above-mentioned composite material producing means.

Figure 2:
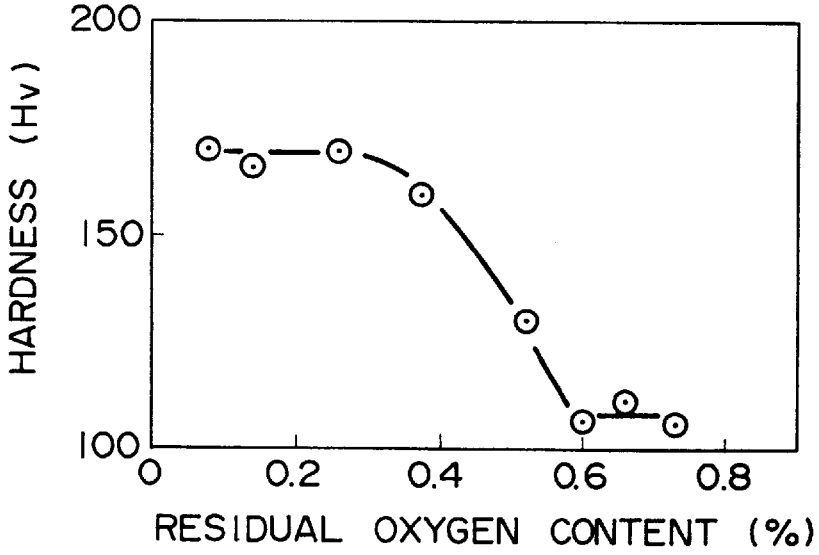
FIG. 2 is a graph showing the relationship between the residual oxygen content and hardness of SiC-reinforced 6061 Al alloy composite material.

As seen in the graph of FIG. 2 which shows the relationship between the residual oxygen content and hardness in SiC-reinforced 6061 Al alloy composite materials (with a whisker content of 20 vol %), the improvement in hardness becomes conspicuous with a content less than 0.4%. In this case, specimens were A of FIG. 1, and the HIP temperature was 625° C., adjusting the residual oxygen content by the use of binders with different oxygen contents.

The control of the residual oxygen content in the composite material differs depending upon the conditions of the manufacturing process, which is largely classified into a powder metallurgy process and a molten forging process (a process of molten forging in which either molten Al alloy is added to SiC whisker preform or SiC is admixed into molten Al alloy). Of these processes, the powder metallurgy includes: a method of mixing SiC and the matrix Al alloy powder by dry mixing or wet mixing using an organic solvent, sintering the mixture to a preliminary shape (in the form of a billet or slab), and hot-shaping the material (by extrusion, rolling or forging), and a method of directly powder-forging the powder mixture. In this case, the residual oxygen content in the composite material is adjusted by controlling the atmosphere in the forming stage.

Further, by orienting the SiC whisker in one direction, the specific strength in the oriented direction as well as specific modulus of elasticity can be improved to a marked degree. The orientation in one direction can be effected by using extrusion or rolling (forced working) in the above-mentioned hot forming stage. When the orientation is not necessary, a forging process is used.

With regard to the shape of SiC to be used in the present invention, it is largely classified into whisker and particles. The whisker is preferred to be 0.1–1.0$\mu$ in diameter and 50–200$\mu$ in length. On the other hand, the particles are preferred to be substantially of a spherical shape having a diameter smaller than 100$\mu$, more preferably, a diameter of several microns to several tens microns.

In any case, the length and size are selected in consideration of feasibility of uniform mixing with the Al alloy powder. Namely, since it is preferable to use Al alloy powder with an average particle size smaller than 100$\mu$, more preferably, smaller than 50$\mu$, uniform mixing of the raw material powder becomes difficult if the length or size of the whisker greatly differs from the particle size of the Al alloy powder.

SiC of either whisker form or particulate form is selected depending upon the particular properties which are demanded in the end use. More specifically, for example, it is desirable to select the whisker shape and to orient the whisker in a case of a structural material which is required to have higher strength and modulus of elasticity despite a small wall thickness like seamless pipes for frames of high class bicycles, because the use of whisker will permit to produce a composite material with strength higher than 50 kgf/mm$^2$ and modulus of elasticity higher than 10,000 kgf/mm$^2$.

On the other hand, a composite material with particulate SiC has strength higher than 45 kgf/mm$^2$ and modulus of elasticity higher than 9,000 kgf/mm$^2$, which are lower than the corresponding values of the composite material with whisker SiC, but it is advantageous in terms of the above-mentioned uniform mixing of the raw material powder and workability in a hot or cold working stage.

Now, the SiC-reinforced Al alloy composite material according to the present invention is described in relation with processes for manufacturing same.

As stated hereinbefore, the starting powder mixture for the composite material consists of a mixture of Al alloy powder for the matrix and SiC added as a reinforcing material. Useful Al alloy powder includes powders of various Al alloys containing 0.4–6.0% of Mg as an aging strengthening element, for example, Al alloys of 6000 series (e.g., 6061), 2000 series (e.g., 2024), 7000 series (e.g., 7075), AC8A and AC8B.

Except for the case of molten forging, the particle size of the Al alloy powder has influences on mechanical properties of the composite material such as strength, modulus of elasticity and elongation, so that it is preferred to be as small as possible. In case of a process by powder metallurgy, the particle size of the Al alloy powder is preferred to be smaller than 200 $\mu$m at largest.

Figure 3:
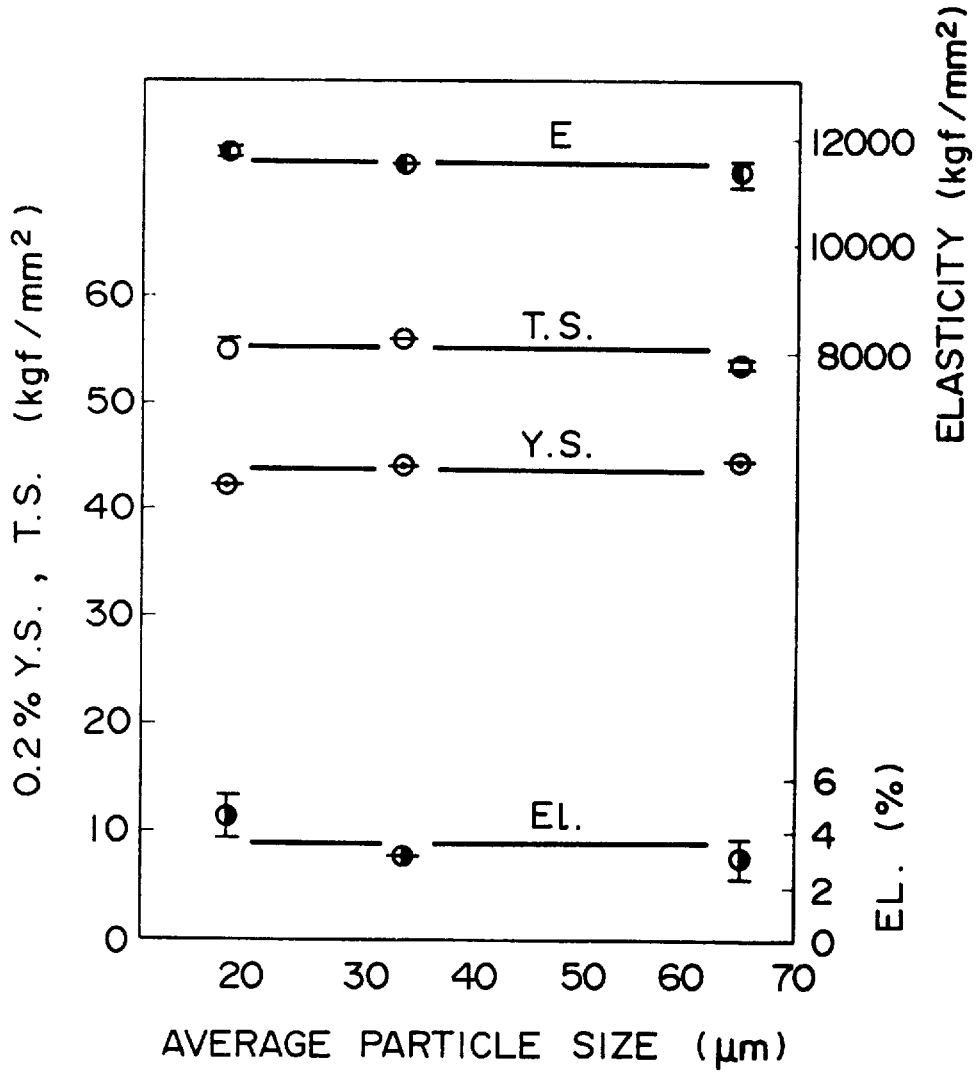
FIGS. 3 to 5 are graphs showing the relationship between the average particle size of Al alloy powder and mechanical properties of various SiC-reinforced Al alloy composite materials.
Figure 4:
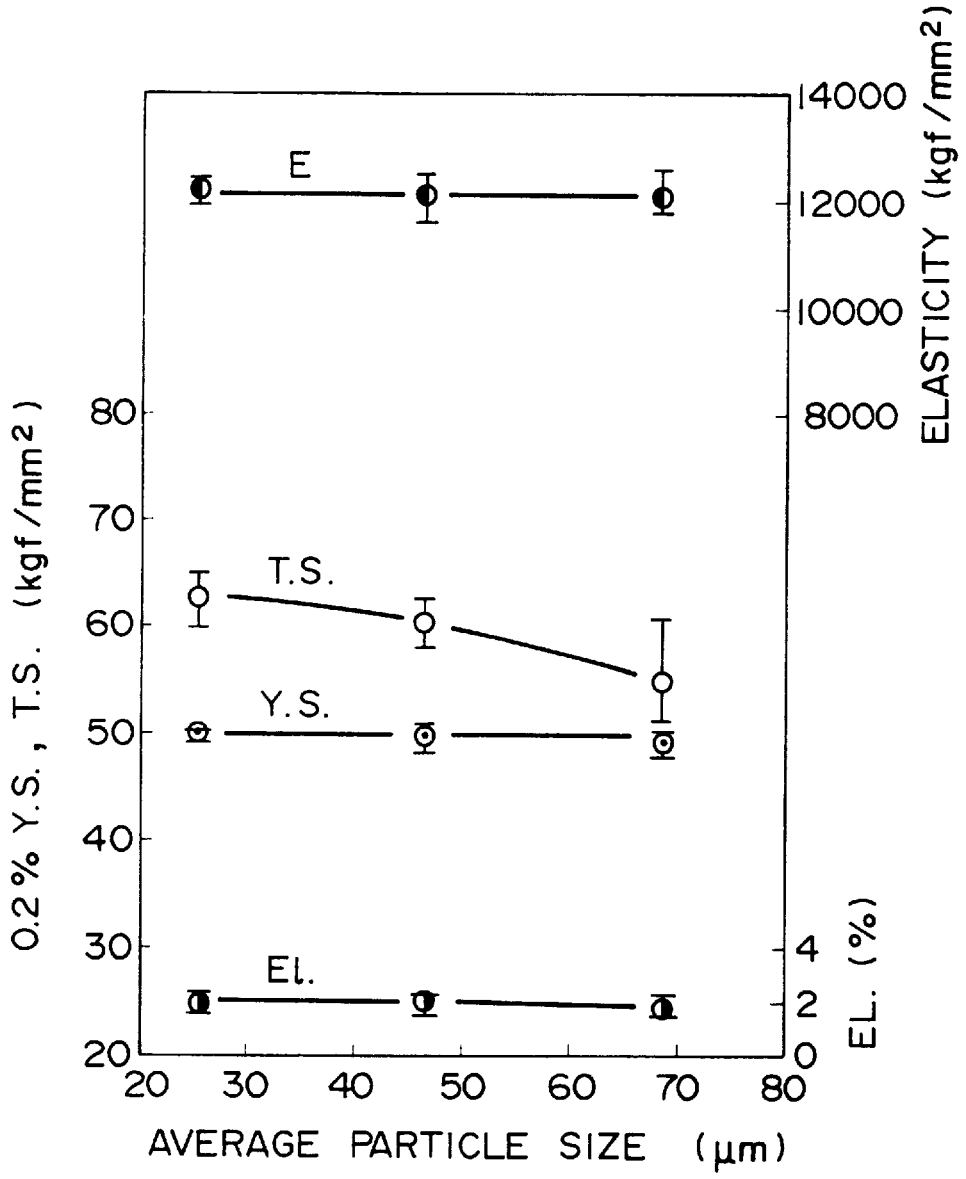
Figure 5:
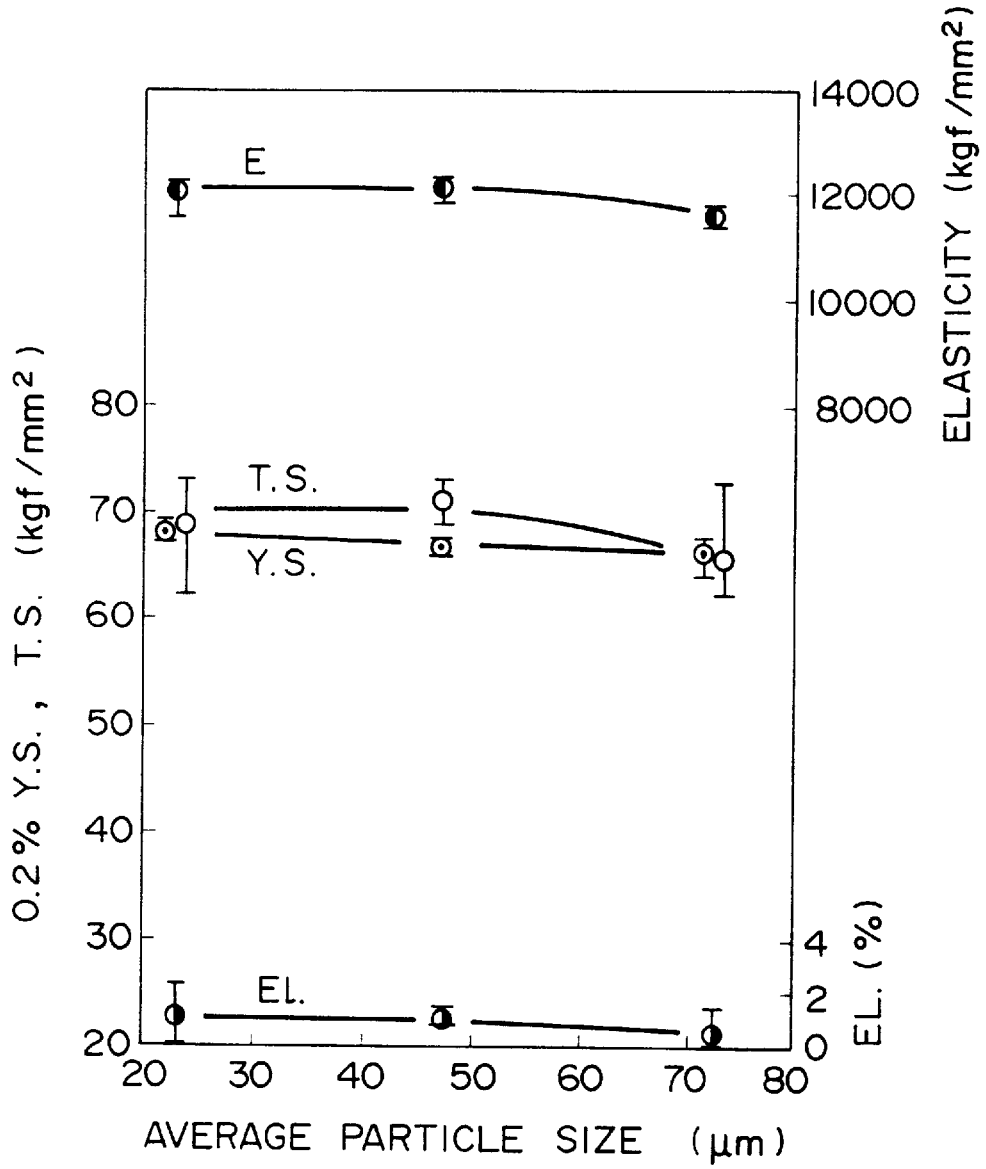

In this connection, FIGS. 3 to 5 show the relationship between the average particle size of Al alloy powder and mechanical properties of various SiC-reinforced Al alloy materials (each with a whisker content of 20 vol %), using as Al alloy powder 6061 in case of FIG. 3, 2040 in case of FIG. 4 and 7075 in case of FIG. 5. In the same manner as described hereinbefore in connection with FIG. 1, specimens were prepared by uniformly mixing Al alloy powder with SiC whisker, forming by HIP a billet for extrusion and extruding at an extrusion ratio of 11.6, followed by T6 treatment. The extruding temperature was 520° C. in case of FIG. 3, 440° C. in case of FIG. 4 and 420° C. in case of FIG. 5. In these figures, E. means modulus of elasticity, T.S. means tensile strength, Y.S. means 0.2% yield strength and EL. means elongation.

In case of FIG. 3 using 6061 Al alloy powder, the influence of the particle size is barely observed since the strength of the 6061 alloy itself is relatively low. However, as seen in FIGS. 4 and 5, the contribution of the particle size becomes greater in case of Al alloys of higher strength than 6061, showing degradations in properties with a greater particle size, especially a marked drop in tensile strength.

The mixing ratio of the Al alloy powder to SiC is determined such that the volumetric rate of SiC fall in the range of 10–30%. The properties such as strength and modulus of elasticity are enhanced in proportion to the volumetric rate of SiC, but the rate of enhancement diminishes with a volumetric ratio in excess of 30%, inviting increased crack losses in a plastic working process like extrusion or rolling. On the other hand, a volumetric rate smaller than 10% will result in a little improvement in strength, with no large difference from conventional ingot Al alloys.

Figure 6:
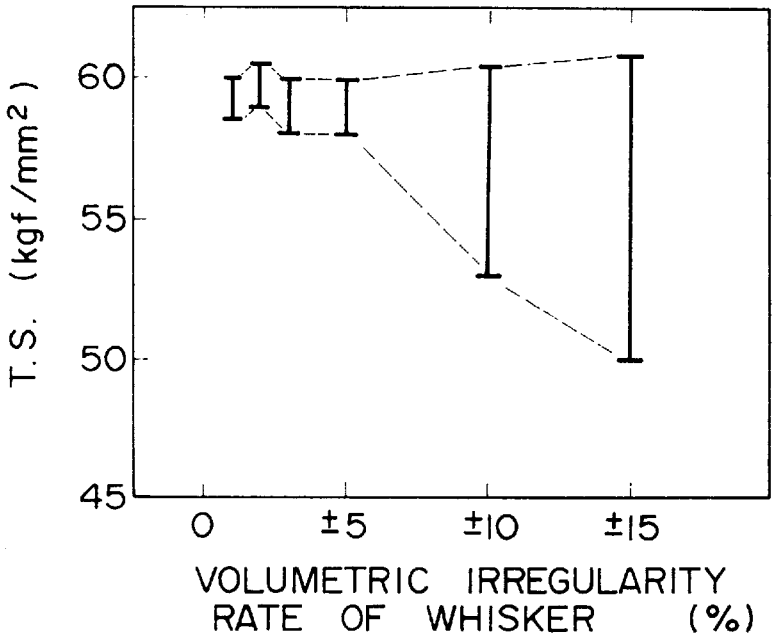
FIG. 6 is a graph showing the relationship between the variation in volumetric proportion of SiC whisker and tensile strength of SiC-reinforced 6061 Al alloy composite material.

The Al alloy powder and SiC should be mixed uniformly with each other to produce composite material which is stable in quality with less differences in properties between various portions thereof. Unless mixed uniformly, for example, aggregates of SiC whisker would lend themselves as a crack starting point. Besides, the distribution of Mg-base aging precipitates in the matrix becomes uneven to lower the fatigue strength as well as the tensile strength. In this connection, FIG. 6 shows the relationship between the rate of irregularity in volumetric rate of SiC whisker and the tensile strength of SiC-reinforced 6061 Al alloy composite materials. As seen therefrom, large irregularities barely occur when the rate of irregularity is less than ±5% of the average volumetric rate (20%) of whisker. The specimens in this case were A of FIG. 1, with various values in the rate of irregularity which was adjusted by varying the degree of uniformity of the mixture powder through adjustment of the ultrasonic frequency in the ultrasonic disentangling treatment on SiC whisker or the amount of the solvent in the stage of mixing into Al alloy powder. Here, the term "rate of irregularity" means a percentage in a target volumetric proportion. For example, in a case where the target rate is 20%, a volumetric rate of 22% is higher than the target rate by 2% and has a rate of irregularity of 2×100/20=10%.

In case of powder metallurgy, the mixture powder may be subjected directly to powder forging as mentioned hereinbefore. However, where the process includes hot forming like extrusion or rolling for the purpose of orienting the SiC whisker depending upon the shape or properties of the final product, it is necessary to preform the mixture to shape by CIP or HIP. When it is difficult to uniformly mix Al alloy powder with SiC directly or by the use of an inorganic solvent, there may be employed mixture pellets having SiC whisker uniformly dispersed in Al alloy powder and retained in a particulate shape (preferably with a particle size of 0.1–5 mm) by an organic binder. The binder is removed from the pellets before press-sintering, or pellets which have been stripped of the binder is used as raw material in the press-sintering stage. Alternatively, after preshaping the pellets into a predetermined form with heating below 400° C. and the resulting preshape may be sent to the press-sintering after removal of the binder.

The binder to be used is preferred to have a pyrolytic temperature below 400° C. and to be of the sort which makes the residual oxygen content in the pellets after removal of the binder less than 0.4% like an acrylic binder, for example. Upon heating in vacuum Al alloy powder which contains precipitation strengthening elements such as Mg, Li and Zn, these elements tend to gasify more easily at higher temperatures, dropping their concentrations in the Al alloy particles. However, such drops in concentration by gasification of the precipitation strengthening elements can be suppressed at a temperature lower than 400° C. In addition, the precipitation strengthening elements like Mg, Li and Zn are apt to bond to oxygen and form oxides at high temperatures, especially at temperatures higher than 400° C., lowering the concentration of these precipitation strengthening elements in the Al alloy particles. Therefore, if the pellets should have a higher oxygen content after removal of the binder at a temperature below 400° C., it could be a larger oxygen source to oxidize the precipitation strengthening elements like Mg, Li and Zn in the Al alloy particles in a subsequent stage of solidified forming at a higher temperature, inviting drops in strength and hardness of the modified metal composite material (MMC).

Where the pellets have a relative density higher than 55%, the binder may be removed at a temperature higher than 400° C. This is because the high density hinders gasification and oxidation of Mg in the Al alloy powder.

After preparation of the mixture powder, the desired SiC-reinforced Al alloy composite material is obtained by a press-sintering in which the mixture powder is charged into a mold and pressed under heating condition or by press-sintering process of a HIP process in which the mixture powder is charged into a HIP capsule and sealed therein after vacuum pumping to undergo the HIP treatment. The press-sintering is normally effected in a solid phase region or solid-liquid region of 400°–625° C. The press-sintering which needs a heating atmosphere may be carried out in the air but improvements in properties can be attained by heating in vacuum.

For forming the Al alloy composite material to shape, there may be employed the so-called hot pressing in which the mixture powder of the Al alloy and reinforcing material fed into a mold of a desired shape is pressed while being maintained at a predetermined temperature.

Figure 9:
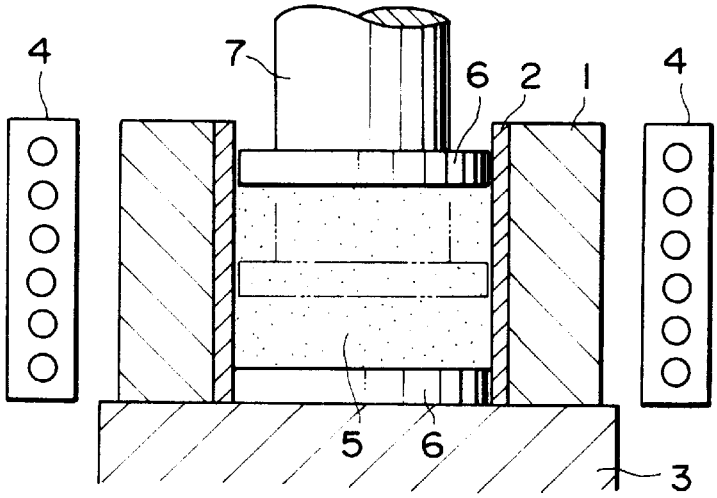
FIG. 9 is a schematic sectional view exemplifying a hot pressing apparatus.

Referring to FIG. 9, there is shown an example of the hot pressing apparatus, which includes a container 1 having an inner sleeve 2 and mounted on a support block 3, and a heater 4 located to circumvent the container 1. Indicated at 5 is a mixture material charged into the container 1 to undergo pressing by a press punch 7 through upper and lower press plates 6. Although omitted from illustration, a temperature control thermocouple is provided inside the container 1. In this figure, the two-dot chain line indicates the state of the material after pressing. In this instance, the powder mixture may consists of Al alloy powder and a reinforcing material or a compact of such mixture powder.

The packed density of such powder mixture is as low as about 25%, and that of the compacts is normally below 50% since it suffices for them to have a strength which is necessary only for handling purposes. Accordingly, the mixture material of this sort contain a multitude of pores or a large quantity of air. Therefore, where the Al alloy powder contains powders of Mg, Li, Zn or other active precipitation strengthening metal elements (hereinafter referred to simply as "strengthening elements"), the strengthening elements in the Al alloy particles are selectively oxidized in the stage of heating the powder mixture to lower their concentrations in the Al alloy. Consequently, it becomes difficult to obtain the aimed strength and hardness even after a solution heat treatment and an aging precipitation heat treatment subsequent to the forming operation.

In this regard, it is generally considered that the oxidation of the strengthening elements can be prevented by heating the powder mixture in vacuum. However, in such a case, the suppression of drops in strengthening element concentrations in Al alloy particles is difficult because the strengthening elements in the Al alloy particles gasify normally in a temperature range above 400° C. and are drawn out by the suction pump.

Therefore, prior to press-sintering the Al alloy particles, it is desirable to press the mixture powder preliminarily into a shape with a high packing rate (hereinafter referred to as "highly packed shape"). The press-forming before sintering contributes to increase the thermal conductivity of the powder mixture to such a degree as to permit to shorten markedly the time for uniformly heating the mixture to a given temperature range, and to reduce the amounts of pores and air in the mixture to suppress the oxidation of strengthening elements like Mg, Li and Zn in the Al alloy particles in a subsequent high temperature heating treatment. In this instance, the packed rate of the preliminary shape is desired to be higher than 55% (preferably higher than 70%). If lower than 55%, the effect of suppressing oxidation of the strengthening elements will become insufficient.

The press-forming of the highly packed shape should be carried out at a temperature lower than 400° C. because the oxidation of the strengthening elements in the Al alloy powder of the mixture material will proceed rapidly at temperatures above 400° C.

Figure 7:
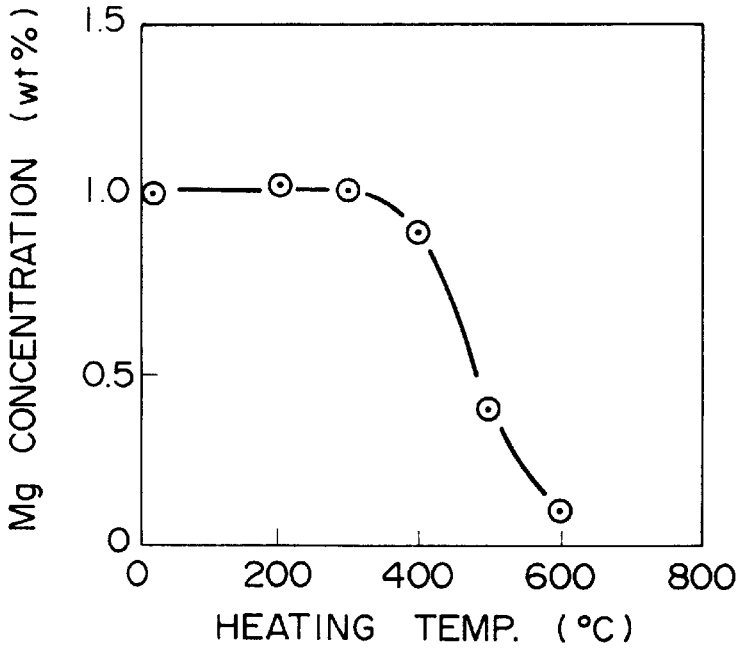
FIG. 7 is a graph showing the relationship between the heating temperature and the Mg concentration in Al alloy powder particles in the powder mixture.

In this connection, FIG. 7 shows the results of measurement of Mg concentration in Al alloy powder particles in powder mixtures which was prepared by uniformly mixing 80 vol % of Al alloy (A 6061) powder with 20 vol % of SiC whisker and heated in the air for 1 hour at a temperature of 100°–500° C. The Mg concentration was analyzed by EPMA (Electron Probe Microanalyzer). As seen therefrom, the Mg concentration abruptly diminishes as the heating temperature becomes higher than 400° C. As a result of the analysis, it was confirmed that the reductions in Mg concentration were mainly attributable to oxidation.

After forming into a highly packed shape, the powder mixture is press-sintered with heating to a solid-phase region or solid-liquid coexisting region of 400°–600° C. This is because sintering is difficult at a temperature below 400° C., while at a temperature above 600° C. a normal press-forming operation is rendered infeasible by melting Al alloy powder.

In a case where the highly packed shape is heated in vacuum to remove residual air therefrom, the oxidation of the strengthening elements will not proceed in any substantial degree even if heated to a high temperature. Besides, upon heating at high temperature, the Al alloy particles show a tendency of being partially bonded to one another by sintering to increase the density. Therefore, gasification of the strengthening elements hardly takes place even in vacuum, and the strengthening elements in the Al alloy particles remain almost free of oxidation when the shape is taken out into the air after the heating and worked by a press-forming operation.

blended in the proportion of 20 vol %. After mixing, the mixture slurry was filtered to remove ethyl alcohol, and the resulting cake was dried to obtain a powder mixture having the SiC whisker and 6061 Al alloy powder uniformly dispersed and mixed therein.

(2) The powder mixture was charged into a HIP capsule of soft steel and, after vacuuming and sealing, subjected to a HIP treatment of 625° C. and 2000 kgf/cm$^2$ for 4 hours.

(3) Thereafter, the capsule was removed, and the composite material was machined to prepare billets for extrusion.

(4) The billets were heated to 520° C. and extruded by a hydrostatic extruder at a stem speed of 5 mm/sec to obtain the following extrudate specimens (E.S.) of different shapes.

Specimen 1: A pipe of 31.0 mm (outside diameter)×29.0 mm (inside diameter);

Specimen 2: A pipe of 15.0 mm (outside diameter)×13.6 mm (inside diameter); and

Specimen 3: Solid rod of 20 mm (outside diameter).

Figure 10:
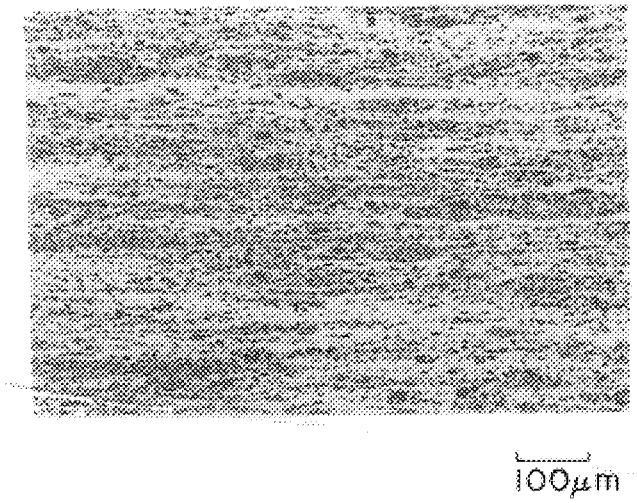
FIGS. 10 and 11 are microphotographs of an alloy prepared as in Example 1 at different magnifications.
Figure 11:
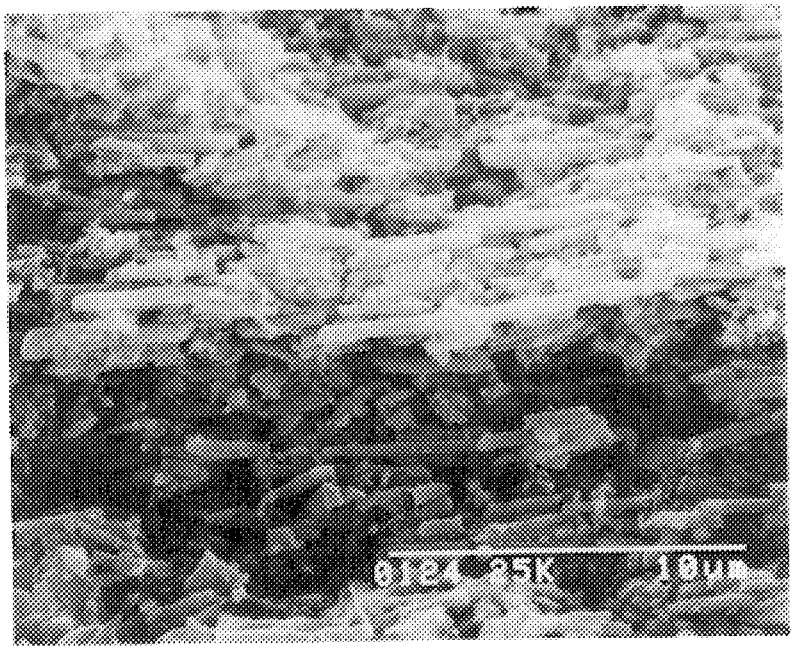

(5) After T6 treatment, the volumetric rate of SiC whisker, content of $Al_4C_3$ and content of residual oxygen, tensile strength and modulus of elasticity in various portions of each extrudate were examined. The results are shown in Table 1 below. The mechanical properties were measured in the direction of whisker orientation. Shown in FIGS. 10 and 11 are structural photographs of Specimen 1, of which FIG. 10 is a structure observed by an optical microscope and FIG. 11 is a structure observed by a scanning electronic microscope after dissolving off the matrix Al alloy from the surface of the specimen.

TABLE 1

| | Extrusion Ratio | Location | SiC Whisker Vol. % | $Al_4C_3$ % | Residual Oxygen % | Tensile St. Kgf/mm$^2$ | Elasticity Kgf/mm$^2$ |
|---|---|---|---|---|---|---|---|
| E.S. 1 | 30 | Head end | 20.2 | 0.11 | 0.09 | 58.6 | 12500 |
| | | Middle | 20.0 | 0.09 | 0.11 | 59.4 | 12400 |
| | | Tail end | 19.8 | 0.04 | 0.08 | 60.2 | 12300 |
| E.S. 2 | 107 | Head end | 20.3 | 0.02 | 0.21 | 59.6 | 12300 |
| | | Middle | 20.1 | 0.04 | 0.15 | 58.5 | 12200 |
| | | Tail end | 19.7 | 0.04 | 0.12 | 59.8 | 12400 |
| E.S. 3 | 12 | Head end | 19.6 | 0.38 | 0.08 | 57.4 | 12000 |
| | | Middle | 19.8 | 0.31 | 0.14 | 58.0 | 12100 |
| | | Tail end | 20.4 | 0.27 | 0.27 | 58.3 | 12000 |

The composite material thus produced has the SiC whisker three-dimensionally oriented in the matrix. However, by orienting the whisker in one particular direction by extrusion or rolling, a marked improvement in strength or modulus of elasticity can be attained depending upon the direction of orientation. Further, where the composite material is extruded into a hollow tubular form, it becomes possible to obtain a structural material which has higher rigidity and reduced weight as compared with a solid rod and which is enhanced all the more in specific modulus of elasticity as well as in specific strength.

The invention is illustrated more particularly by the following Examples.

EXAMPLE 1

(1) SiC whisker and 6061 Al alloy powder, with a classified particle size smaller than 350 mesh (smaller than 44$\mu$, max.), were dispersively mixed in ethyl alcohol with application of ultrasonic vibrations. The whisker was (6) Evaluation As seen in Table 1, each one of Specimens 1 to 3 contains little variations in volumetric rate of SiC whisker, exhibiting substantially the same properties in each of the examined portions. In addition, the contents of $Al_4C_3$ and residual oxygen are held in the predetermined ranges in the respective specimens, ensuring excellent mechanical properties including tensile strength higher than 50 Kgf/mm$^2$ and elastic modulus higher than 12000 kgf/mm$^2$. Further, from FIGS. 10 and 11, SiC whisker is confirmed to have been uniformly dispersed and oriented in one direction in the matrix of the Al alloy which has been stretched in the working (extruding) direction.

EXAMPLE 2

(1) Example 1 was repeated except that the powder mixture was hot-pressed with application of a pressure of 6000 kgf/mm$^2$, obtaining a highly packed shape with a packing rate of 93%.

(2) After the same treatments as in (3) and (4) of Example 1, highly packed shape showed a hardness of 167 Hv and a strength of 55 kgf/mm$^2$.

(3) As a result, it was confirmed that a higher packing rate of the shape has a greater effect in suppressing oxidation of the strengthening elements in the Al alloy particles, contributing to producing satisfactory properties, extremely enhancing both the hardness and strength of the finally shaped product.

EXAMPLE 3

(1) Hot-pressing was carried out under the same conditions as in Example 1 to obtain a highly packed shape.

(2) The highly packed shape was heated to 560° C. in a heating furnace holding an atmosphere as shown in Table 2 below, and after soaking, taken out into the air and immediately finish-forged by the use of a die heated to 560° C. Table 2 also shows the forging atmospheres used.

TABLE 2

| Specimen | Heating Atmosphere | Forging Atmosphere |
|---|---|---|
| A1 | Ordinary $N_2$ gas | Atmospheric air |
| A2 | High purity $N_2$ gas | Atmospheric air |
| B | Vacuum ($10^{-2}$ torr) | Atmospheric air |
| C1 | Ordinary $N_2$ gas | Ordinary $N_2$ gas |
| C2 | High purity $N_2$ gas | High purity $N_2$ gas |
| D | Ordinary $N_2$ gas | Vacuum ($10^{-2}$ torr) |

Figure 8:
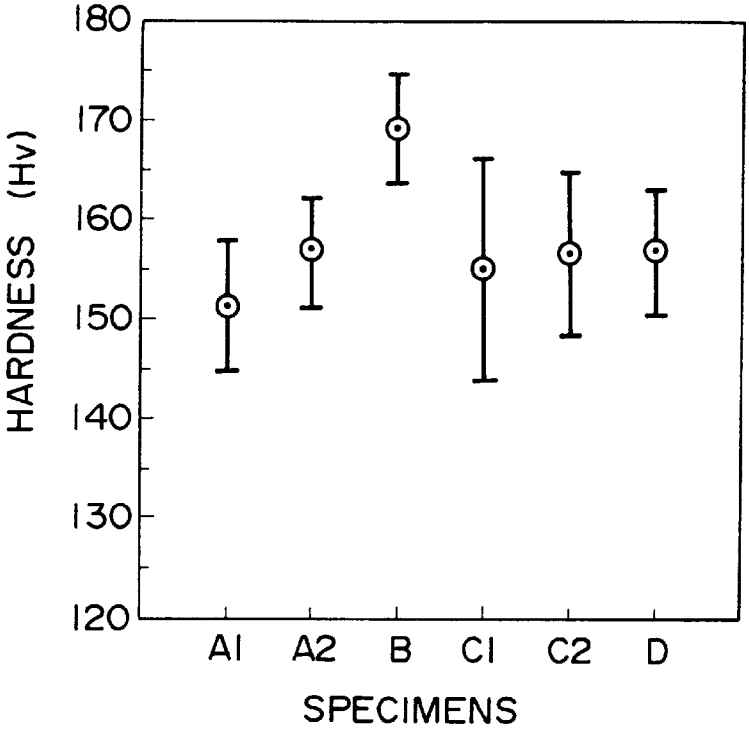
FIG. 8 is a graph plotting the hardness of sintered products after a strengthening heat treatment in a number of examples employing different conditions in the HIP stage.

(3) After processing the sinters resulting from the forging through the same heat treatment as in (4) of Example 1, the sintered final products were tested for Vickers' hardness. The results are shown in FIG. 8, in which a circle indicates an average value and the lines above and below the circle indicate a range of data variations.

As seen therefrom, the specimen (A2), heated in the atmosphere of high purity $N_2$ gas and formed in the air, had a higher hardness than the specimen Al which was heated in the ordinary $N_2$ gas atmosphere with a slight moisture content and forged in the air. On the other hand, the specimen B which was heated in vacuum exhibited the highest hardness.

As clear from the foregoing description, by suppressing the contents of $Al_4C_3$ and residual oxygen in the composite material below predetermined values, the SiC-reinforced Al alloy composite mate rial according to the invention has succeeded in bonding the matrix Al alloy and SiC whisker securely to each other and in such a way as to contribute to the age hardening of Mg in the matrix alloy, improving the strength, modulus of elasticity and other properties markedly for a given matrix Al alloy with a given proportion of whisker.

Further, the specific strength and specific modulus of elasticity of the composite material can be improved all the more by orienting the whisker in one direction.

What is claimed is:

1. In a SiC-reinforced press-sintered aluminum alloy composite material having silicon carbide uniformly dispersed in an aluminum alloy matrix containing magnesium as a strengthening element, the improvement comprising that said composite material is press-sintered at 400°–625° C. and contains $Al_4C_3$ in an amount smaller than 0.5 wt % and residual oxygen in an amount smaller than 0.4 wt %, and has a modulus of elasticity of at least 12,200 kgf/mm$^2$.

2. A SiC-reinforced aluminum alloy composite material as defined in claim 1, wherein said silicon carbide is in the form of whisker and oriented in one direction in a uniformly dispersed state.

* * * * *